US005705797A

United States Patent [19]

Seo

[11] Patent Number: 5,705,797

[45] Date of Patent: Jan. 6, 1998

[54] UNITARY MICROWAVE OVEN DOOR

[75] Inventor: Dong Wan Seo, Kyungsangnam-do, Rep. of Korea

[73] Assignee: LG Electronics Inc., Seoul, Rep. of Korea

[21] Appl. No.: 583,433

[22] Filed: Jan. 5, 1996

[30] Foreign Application Priority Data

Apr. 3, 1995 [KR] Rep. of Korea ..... 1995/7732

[51] Int. Cl.[6] ..... H05B 6/76

[52] U.S. Cl. ..... 219/742; 219/743; 174/35 GC

[58] Field of Search ..... 219/742, 741, 219/743, 740; 174/35 GC

[56] References Cited

U.S. PATENT DOCUMENTS

| | | | |
|---|---|---|---|
| 4,166,207 | 8/1979 | Burke | 219/743 |
| 4,713,511 | 12/1987 | Katoh | 219/740 |
| 4,742,201 | 5/1988 | Nakano et al. | 219/742 |
| 4,868,359 | 9/1989 | Iwabuchi et al. | 219/743 |
| 5,036,171 | 7/1991 | Kim et al. | 219/742 |
| 5,075,525 | 12/1991 | Jung | 219/742 |
| 5,206,478 | 4/1993 | Lee | 219/742 |
| 5,418,352 | 5/1995 | Cho | 219/742 |

*Primary Examiner*—Philip H. Leung
*Attorney, Agent, or Firm*—John P. White

[57] ABSTRACT

A door for preventing leakage of electromagnetic wave of a microwave oven includes: a front panel forming a front surface of a door; a first contact surface expanded from the circumference of the front panel and recessed forward a cavity of the microwave oven so as to contact an entrance of the cavity; a door frame portion expanded from the circumference of the first contact surface and proceeding to the front surface of the door so as to form a frame of the door; a second contact surface expanded from the circumference of the door frame portion and recessed toward the cavity so as to contact a frame of the cavity entrance; a choke cavity formed between the door frame and the second contact surface; and a slit formed on the circumference of the door frame in a predetermined interval and expanded into the choke cavity in a predetermined length. Thus, leakage of the electromagnetic wave can be prevented due to the slit shape of a predetermined period. Also, various designs can be provided by making the door panel to be attached of detached to/from the door frame.

2 Claims, 5 Drawing Sheets

UNITARY MICROWAVE OVEN DOOR

BACKGROUND OF THE INVENTION

The present invention relates to a door of a microwave oven, and more particularly to a door of a microwave oven made of a single metal plate and for preventing leakage of a high-frequency.

The door of a conventional microwave oven is shown in FIGS. 1 to 3. The conventional door comprises a front panel 31 where a porosity portion 311 with numerous apertures and a slit portion 32 formed around front panel 31. Slit portion 32 is for preventing leakage of electromagnetic wave. Front panel 31 and slit portion 32 form a door frame 3. Also, the conventional door comprises a door panel 4 being fixed and enclosing the front side and circumferential surface of door frame 3, a choke cover 5 inserted between front panel 31 and slit portion 32 and a front screen 6 adhered to door panel 4. A reference numeral 321 denotes a choke cavity.

A high-frequency wave leaked from a cavity 1 comes inside choke cavity 321 of the door of such a structure and is attenuated by slit portion 32 of a constant period.

There are problems in the conventional door as follows.

First, front panel 31 adheres closely to cavity 1 and slit portion 32 is protruded and folded at the circumferential surface of front panel 31 so that front panel 31 appears concave when viewing from the outward. Accordingly, an additional door panel 4 must be installed on a front surface to maintain a planar appearance.

Second, the weak slit portion can be deformed during assembly or handling thereof. Thus, the high-frequency can be leaked through the deformed slit portion.

Third, choke cover 5 is assembled by simply inserting the same between front panel 31 and slit portion 32. Thus, choke cover 5 can be fell into choke cavity 321 during assembly thereof.

SUMMARY OF THE INVENTION

To solve the above problems, it is an object of the present invention to provide a door of which a front surface is planar by manufacturing a single metal plate.

It is another object of the present invention to provide a door where the choke cover is stably fixed to the choke cavity and the slit portion.

It is still another object of the present invention to provide a door for shielding a high frequency wave by a first and second metal contact, high-frequency inversion and modulation wave formation.

It is yet another object of the present invention to provide a door where the deformation of the slit is prevented by reinforcing strength of the slit.

Accordingly, to achieve the above objects, there is provided a door for preventing leakage of electromagnetic wave of a microwave oven includes: a front panel forming a front surface of a door; a first contact surface expanded from the circumference of the front panel and recessed forward a cavity of the microwave oven so as to contact an entrance of the cavity; a door frame expanded from the circumference of the first contact surface and proceeding to the front surface of the door so as to form a frame of the door; a second contact surface expanded from the circumference of the door frame and recessed forward the cavity so as to contact a frame of the cavity entrance; a choke cavity formed between the door frame and the second contact surface; and a slit formed on the circumference of the door frame in a predetermined interval and expanded into the choke cavity in a predetermined length.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

A preferred embodiment of the present invention will now be described in detail, referring to FIGS. 4 to 9.

Figure 1:
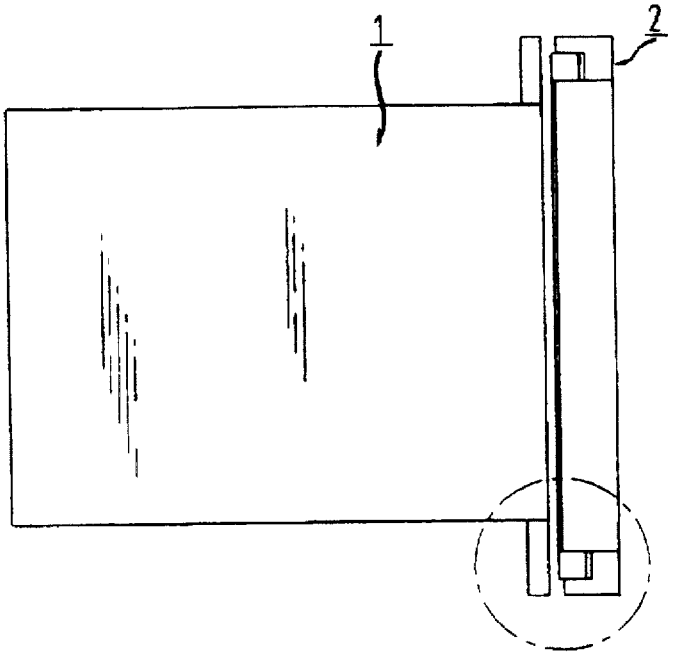
FIG. 1 prior art
FIG. 1 is a vertical cross section illustrating a door structure of a conventional microwave oven.
Figure 2:
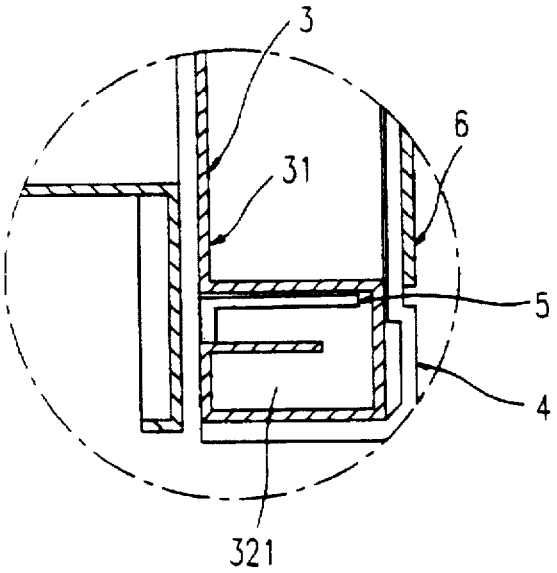
FIG. 2 prior art
FIG. 2 is an amplified cross section of "A" portion of FIG. 1.
Figure 3:
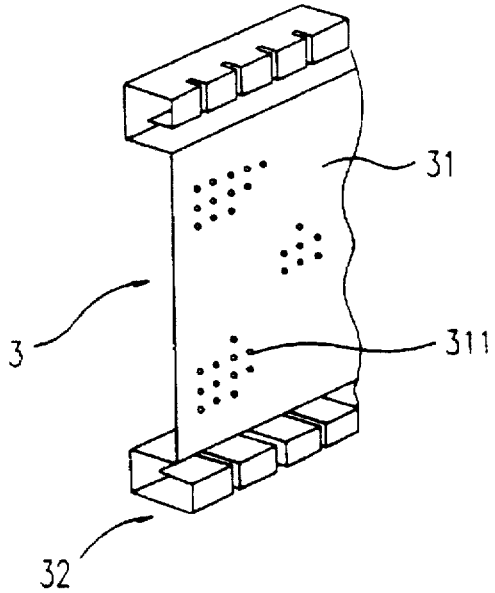
FIG. 3 prior art
FIG. 3 is a perspective view of a conventional door frame.
Figure 4:
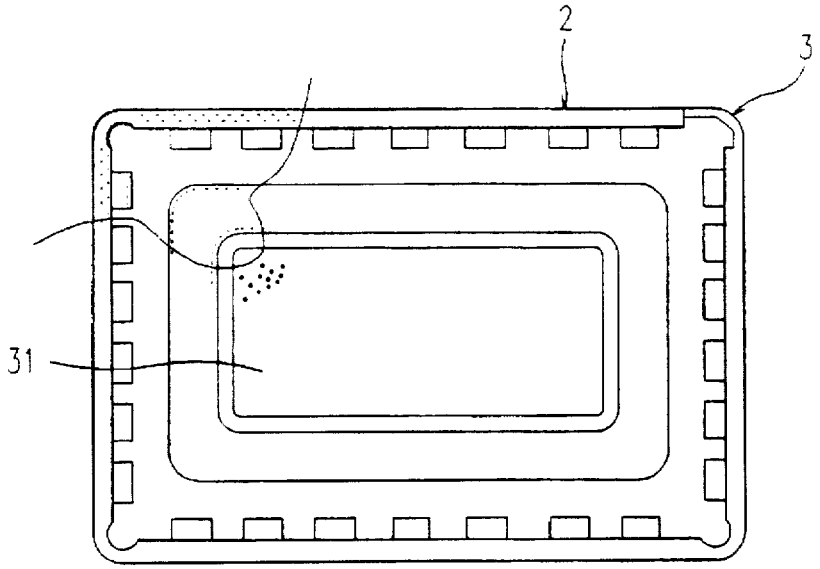
FIG. 4 is a rear view partially illustrating a door structure according to one embodiment of the present invention.
Figure 5:
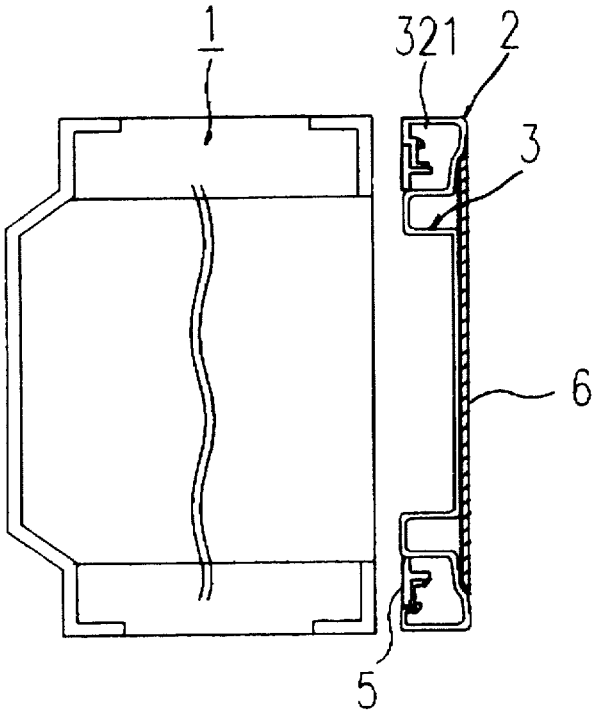
FIG. 5 is a section showing a structure of a door of a microwave oven of the present invention.
Figure 6:
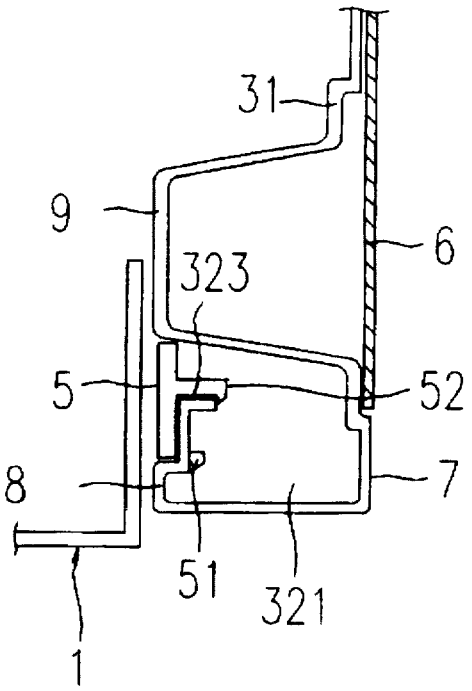
FIG. 6 is an amplified section of a core portion of the present invention.

As shown in FIGS. 4 to 6, the preferred embodiment of the present invention comprises a front panel 31 forming a front surface of a door 2, a first contact surface 9 expanded from the circumference of a front panel 31 and recessed forward a cavity 1 of a microwave oven so as to contact an entrance of cavity 1, a door frame portion 7 expanded from the circumference of first contact surface 9 and proceeding to the front surface of the door so as to form a frame of the door, a second contact surface 8 expanded from the circumference of door frame portion 7 and recessed forward the cavity so as to contact a frame of cavity entrance, a choke cavity 321 formed between door frame portion 7 and second contact surface 8, and a slit 32 formed on the circumference of door frame portion 7 in a predetermined interval and expanded into choke cavity 321 in a predetermined length.

As shown in FIG. 6, choke cover 5 adhered to a slit 323 has a hook 52, and hook 52 is hooked by a catch (see 324 of FIG. 10) of slit 323.

Figure 11:
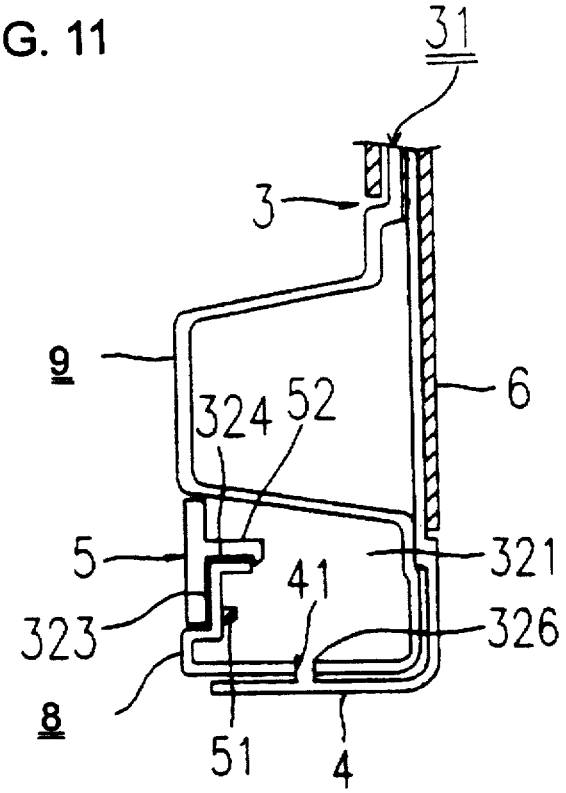
FIG. 11 is a section of a core portion of the door structure using the door frame of FIG. 10.
Figure 12:
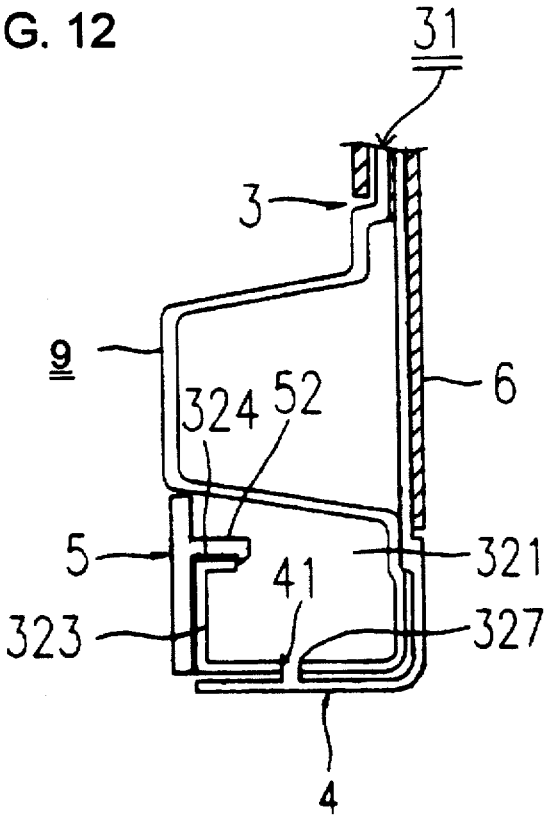
FIG. 12 is a section showing another embodiment of the slit of the present invention.

As shown in FIGS. 11 and 12, a hook groove 326 (and 327) is provided on a bottom surface of choke cavity 321. A door panel 4 having hook 41 is fit to hook groove 326 (and 327). door panel 4 is adhered in order to form various designs on a door surface.

Figure 7:
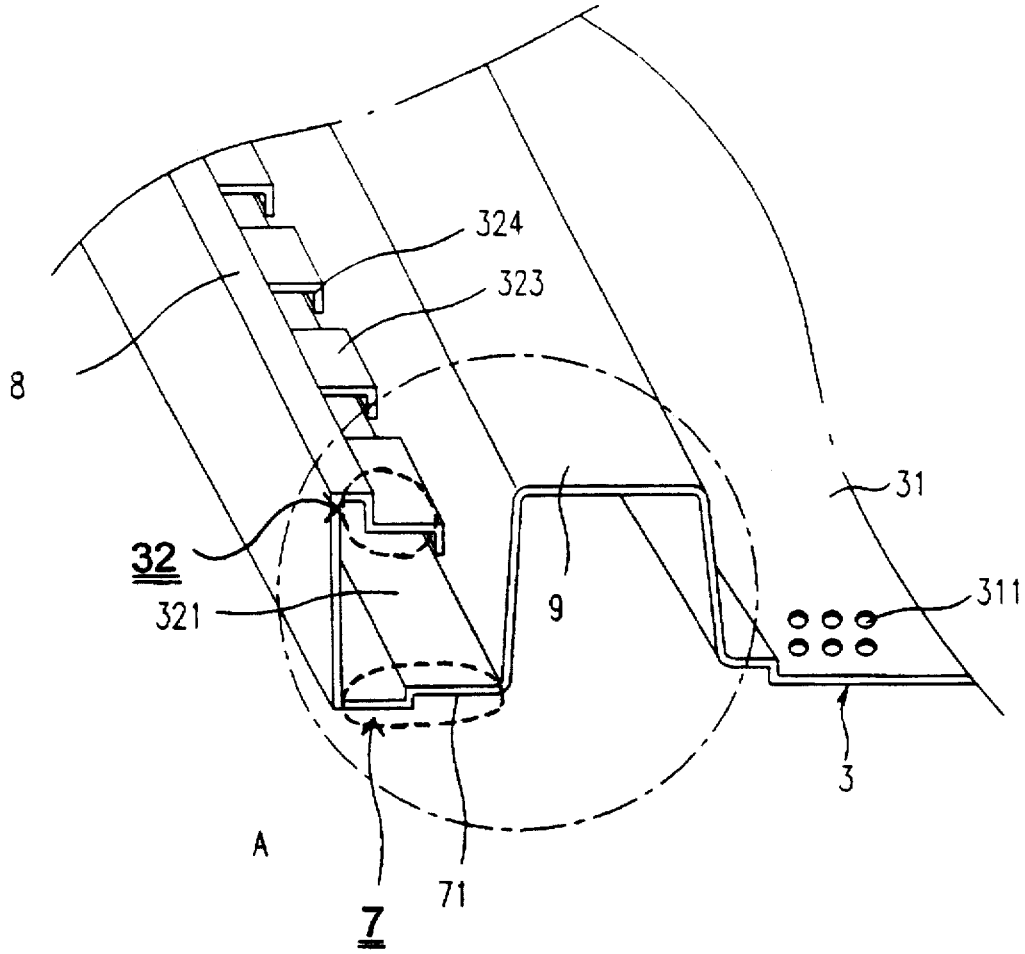
FIG. 7 is a perspective view of a door frame of the present invention.

As shown in FIG. 7, slit portion 32 is expanded as making surfaces in parallel with and perpendicular to the front panel. A rectangular groove for holding a front screen 6 is formed on door frame portion 7.

Figure 10:
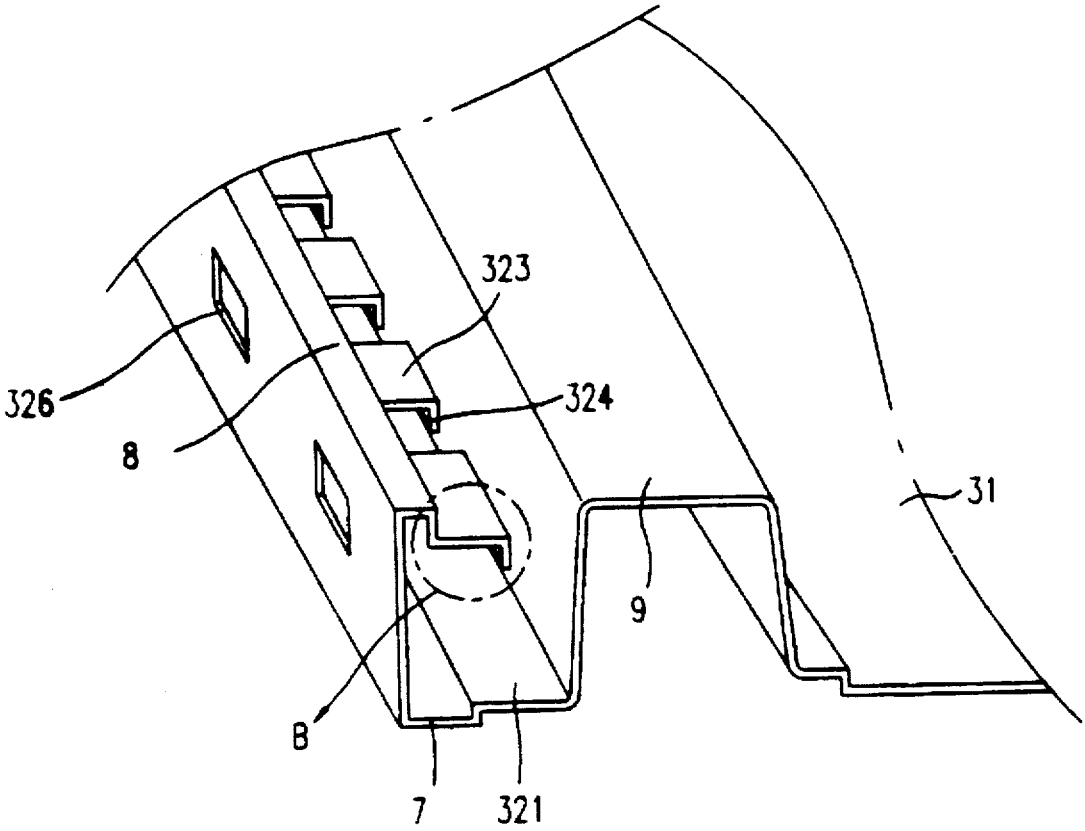
FIG. 10 is an amplified section of a core portion of the door frame according to yet another embodiment of the present invention.

A portion (A) of FIG. 7 is where shielding of a high-frequency is performed, and a portion (B) of FIG. 10 and a portion (C) are a slit and choke cavity, respectively. The slit (B) is formed with a period. A catch 324 is formed for reinforcing strength and preventing leakage by folding the end portion of the slit (B) back toward choke cavity 321.

Figure 8:
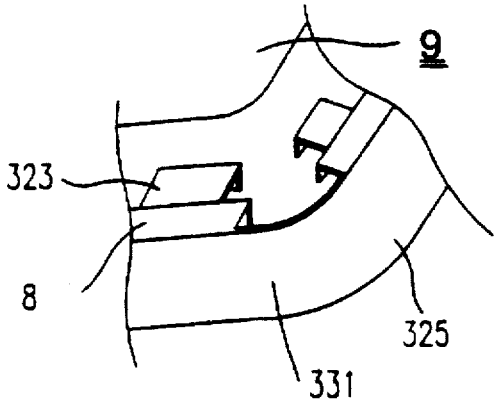
FIG. 8 is an amplified perspective view of a corner of the door frame of the present invention.

As shown in FIG. 8, first contact portion 9, choke cavity 321, second contact portion 8 and slit 32 are connected with integrally curved surface 331 and 325 by drawing each corner thereof.

As shown in FIG. 6, choke cover 5 is assembled to be supported by slit 323 by inserting hook 52 in catch 324.

The operation of the present invention having such a structure will be now described.

Electromagnetic wave leaked from cavity 1 is first blocked by a contact surface between cavity 1 and door 2 in a metal to metal connection method, as shown in FIG. 6. That is, first contact portion 9 of door panel 4 is closely adhered to cavity 1 via the metal to metal to thereby prevent the leakage of electromagnetic wave in a first stage. Then, the electromagnetic wave partially leaked between cavity 1 and door 2 flows in the choke cavity (C) and then is secondly attenuated in a $\lambda/4$. Also, the slit portion folded into multiple steps forms a modulated wave, thus thirdly shielding the electromagnetic wave. Finally, still leaking fine electromagnetic wave is fourthly shielded by a contact of cavity 1 and second contact surface 8 connected in the metal to metal.

Meanwhile, since the outer surface is formed by forwardly folding front panel 31 of door frame 3, assembly of the additional door panel 4 is no more needed. Also, volume of cavity 1 can be enlarged by replacing the conventional door panel 4 with the outer surface of front panel 31.

Door panel 4 can assembled to diversely meet user's desire for various surface design of door 2. That is, door panel 4 can be easily assembled by forming groove 326 on the outer circumferential surface of the choke cavity and protrusively forming hook 42 on the inner circumferential surface of door panel 4. Thus, simple assembling of door frame 3 and door panel 4 provide various door designs to microwave ovens.

Front screen 6 is closely adhered to rectangular groove 71 in case of using door frame 3 only, and in case of using door panel 4 as in FIGS. 10 and 11, the front screen is adhered as in conventional technology.

When choke cover 5 is assembled to slit 2, each hook 52 of choke cover 5 is inserted into catch 324 formed on slit 323 of the slit portion so as to be supported by slit 323. Accordingly, choke cover 5 can be assembled being closely adhered to cavity 1 without being fell into choke cavity 321.

Figure 9:
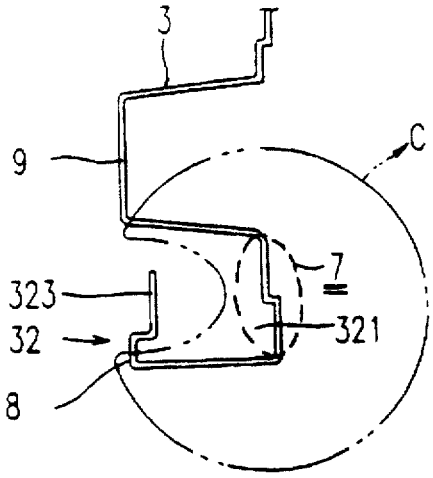
FIG. 9 is an amplified section of a core portion of the door frame according to another embodiment of the present invention.

As another embodiment of the present invention, as shown in FIG. 9, catch 324 at the end portion of slit 323 of the one embodiment can be omitted, thus forming the modulated wave by case and being applied to diverse cases.

As yet another embodiment of the present invention, as shown in FIG. 12, the slit portion can be expanded to the choke cavity for the various design of the door.

As described above, the present invention having a door surface by manufacturing the door frame with a single steel plate can prevent leakage of the electromagnetic wave due to the slit shape of a predetermined period. Also, various designs can be provided by making the door panel to be attached of detached to/from the door frame.

What is claimed is:

1. A unitary microwave oven door comprising:

a front panel forming a front surface of a door;

a first contact surface continuous with said front panel and recessed toward a cavity of said microwave oven to form a planar face to come into contact with an entrance to said cavity;

a door frame portion continuous with said first contact surface and formed in the same plane with said front panel; and a slit portion with said door frame portion and bent in a C-shaped configuration to form a choke cavity, said slit portion having a vertical face to come into contact with an entrance of said cavity and an upper horizontal face to form a catch, wherein the front panel, the first contact surface, the door frame portion and the slit portion are all formed from one continuous plate.

2. A unitary microwave oven door as claimed in claim 1, wherein said vertical face of said slit portion has a stepped configuration.

* * * * *